United States Patent [19]

Heller et al.

[11] 4,149,843

[45] Apr. 17, 1979

[54] CIGARETTE LIGHTER HAVING A PIEZOELECTRIC IGNITION MECHANISM

[75] Inventors: Heinz Heller, Rodenkirchen; Winfried Brand, Troisdorf; Peter Gogovic, Leverkusen, all of Fed. Rep. of Germany

[73] Assignee: Ronson Gesellschaft mit beschränkter Haftung, Cologne, Fed. Rep. of Germany

[21] Appl. No.: 827,378

[22] Filed: Aug. 24, 1977 (Under 37 CFR 1.47)

[30] Foreign Application Priority Data

Aug. 27, 1976 [DE] Fed. Rep. of Germany ..... 2639243

[51] Int. Cl.[2] ..... F23Q 2/01

[52] U.S. Cl. ..... 431/266; 431/255

[58] Field of Search ..... 431/255, 254, 131, 344, 431/264, 266

[56] References Cited

U.S. PATENT DOCUMENTS

| | | | |
|---|---|---|---|
| 3,741,714 | 6/1973 | Yoshinaga | 431/255 |
| 3,832,127 | 8/1974 | Moriya | 431/255 X |
| 4,074,962 | 2/1978 | Vamier | 431/255 |

*Primary Examiner*—Edward G. Favors

*Attorney, Agent, or Firm*—Toren, McGeady and Stanger

[57] ABSTRACT

In a cigarette lighter with a piezo-electric ignition mechanism and an electrode, the electrode is secured in an open-topped recess in a holder by a pin. The electrode is shaped to fit between the wall of the recess and the pin. A head on the pin forms a cover for the recess.

7 Claims, 2 Drawing Figures

CIGARETTE LIGHTER HAVING A PIEZOELECTRIC IGNITION MECHANISM

SUMMARY OF THE INVENTION

This invention relates to cigarette lighters of the kind which are provided with a piezo-electric ignition mechanism. In such lighters an insulated conductor extends from the mechanism to the vicinity of the burner valve where the exposed end of the conductor forms one electrode of a spark gap. For simplicity the insulated conductor will be referred to herein as the electrode.

In lighters of this kind it is important that the end of the electrode be located in a predetermined fixed position since if any movement occurs it may be difficult or impossible to produce a spark capable of igniting the gaseous fuel.

Up to now a secure fixing of the electrode has been attempted by the use of one or other of two different methods. In the first the electrode is secured in position by means of an adhesive but, apart from the difficulty of finding an adhesive which bonds satisfactorily both with the material of the lighter housing and the insulating covering of the electrode, the method is unsatisfactory since the hardening time of the adhesive adversely affects assembly during manufacture. The second method uses a mechanical arrangement to fix the electrode but such arrangements as have been proposed hitherto are unsatisfactory and too expensive.

It is an object of the present invention to provide an improved mechanical arrangement for fixing the electrode which not only is inexpensive to produce but also enables assembly to be carried out both quickly and easily.

According to the present invention in the improved lighter the electrode is secured in position by means of a holder formed to provide an open-topped recess having slots in its wall which define inlet and outlet openings for the electrode, and a pin which enters a bore in the base of the recess and serves to clamp the electrode against the wall of the recess.

The improved lighter of this invention has the advantage that the electrode can be quickly and simply secured in the holder since the electrode can be inserted from above into the recess and the slots leading thereto and is clamped in position by insertion of the pin also from above.

Assembly is particularly simple if the pin has a head of such size that it covers and closes off the recess, and also if the electrode is pre-formed to the shape of the wall of the recess against which it is clamped.

Figure 1:
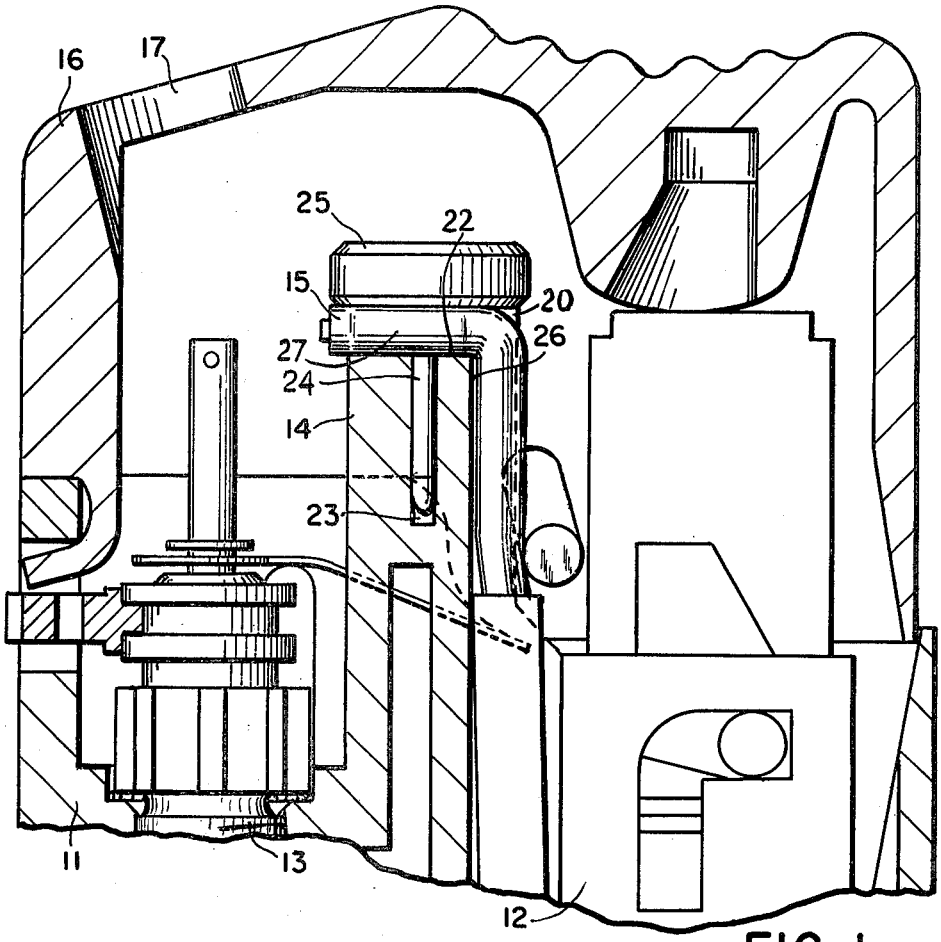
Figure 2:
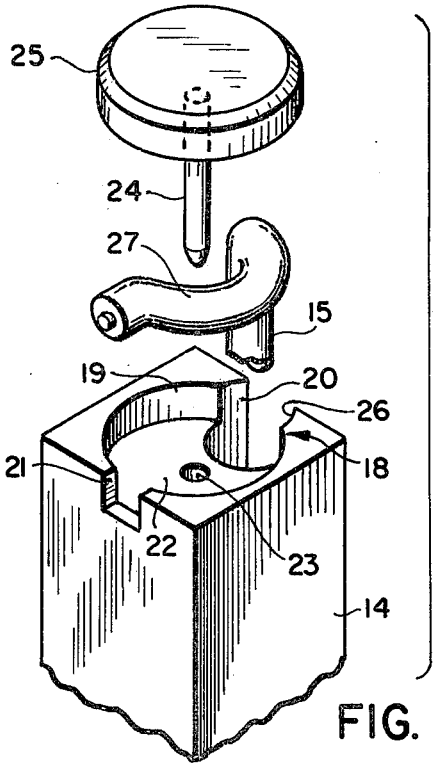

One form of the improved lighter of the invention will now be described with reference to the accompanying drawings in which:

FIG. 1 is a central longitudinal section of a gas fuelled lighter having piezo-electric ignition mechanism, and FIG. 2 is an exploded perspective view of the electric holder.

The lighter shown in FIG. 1 has a housing 11 accommodating a piezo-electric ignition device 12 and provided with a burner valve 13. In the vicinity of the burner valve is a holder 14 for an electrode 15, the holder extending upwards as a column. The ignition device, the burner valve and the holder are covered by a cap-type actuating member 16 having a flame outlet opening 17.

As can be seen from FIG. 2, the holder 14 is formed at its upper end with an open-topped recess 18 through the wall 19 of which extend slots 20 and 21, these slots forming inlet and outlet openings for the electrode 15. At the bottom 22 of the recess 18 is a bore 23 which receives a pin 24. As shown, the pin is formed with a head 25 which is dimensioned to cover the recess and slots, and also serves to facilitate insertion of the pin in the bore 23.

It will be appreciated that when the electrode is laid in the slots 20 and 21 and across the recess 18 insertion of the pin 24 into the bore 23 locks the electrode between the pin and the wall 19 of the recess.

In the arrangement shown one side of the column-like holder 14 is formed with a guide groove 26 which accommodates that part of the electrode which extends from the ignition device 12 to the holder 14, such part extending at right angles to the part 27 of the electrode which passes through the recess 18. The electrode is conveniently pre-formed prior to assembly not only to provide the right angle bend but also to shape the part 27 to the shape of the wall of the recess 18 against which it is clamped.

In a convenient arrangement the recess 18 is generally of circular shape while the bore 23 may be positioned centrally of the recess or possibly somewhat off-centre.

The outlet opening for the electrode 15 formed by the slot 21 and head 25 of pin 24 is dimensioned to receive the electrode as a close fit and so as to ensure that this electrode takes up an accurately adjusted position.

What we claim is:

1. A cigarette lighter of the kind having a piezo-electric ignition mechanism and an electrode extending from the mechanism to the vicinity of a burner valve wherein the electrode is secured in position by means of a holder formed to provide an open-topped recess having slots in its wall which define inlet and outlet openings for the electrode and a pin which enters a bore formed in the base of the recess and serves to clamp the electrode against the wall of the recess.

2. A lighter as claimed in claim 1 wherein the pin has a head of such size that it covers the recess.

3. A lighter as claimed in claim 1 wherein the electrode is preformed to the shape of the wall against which it is clamped.

4. A lighter as claimed in claim 1 wherein the recess is generally circular in shape and the bore for receiving the pin is arranged off-centre.

5. A lighter as claimed in claim 1 wherein the inlet and outlet openings are arranged at opposite sides of the recess.

6. A lighter as claimed in claim 1 wherein the outlet opening is dimensioned to receive the electrode as a close fit.

7. A lighter as claimed in claim 1 wherein the holder is formed as a column with the recess formed in its end and one side of the column is grooved to receive a part of the electrode which extends at right angles to that part within the recess and leads to the piezo-electric mechanism.

* * * * *